US005975031A

United States Patent [19]

Bartolazzi

[11] Patent Number: 5,975,031

[45] Date of Patent: Nov. 2, 1999

[54] COOLING SYSTEM FOR AN INTERNAL COMBUSTION ENGINE, PARTICULARLY FOR MOTOR VEHICLES

[75] Inventor: Andrea Bartolazzi, Rome, Italy

[73] Assignee: Gate S.p.A., Asti, Italy

[21] Appl. No.: 09/151,801

[22] Filed: Sep. 10, 1998

[51] Int. Cl.[6] ..... F01P 7/00

[52] U.S. Cl. ..... 123/41.1; 123/41.02; 123/41.08; 123/41.09; 123/41.44

[58] Field of Search ..... 123/41.02, 41.08, 123/41.09, 41.1, 41.44; 137/895, 543

[56] References Cited

U.S. PATENT DOCUMENTS

| | | | |
|---|---|---|---|
| 3,302,696 | 2/1967 | Rogers . | |
| 4,381,736 | 5/1983 | Hirayama | 123/41.1 |
| 4,545,333 | 10/1985 | Nagumo et al. | 123/41.02 |
| 4,726,325 | 2/1988 | Itakura | 123/41.1 |
| 4,759,316 | 7/1988 | Itakura | 123/41.08 |
| 4,771,739 | 9/1988 | Hapka | 123/41.1 |
| 5,036,803 | 8/1991 | Nolting et al. | 123/41.1 |
| 5,390,632 | 2/1995 | Ikebe et al. | 123/41.02 |
| 5,482,010 | 1/1996 | Lemberger et al. | 123/41.1 |
| 5,494,005 | 2/1996 | Saur | 123/41.1 |
| 5,529,025 | 6/1996 | Ranzinger et al. | 123/41.1 |
| 5,555,854 | 9/1996 | Huemer et al. | 123/41.1 |

FOREIGN PATENT DOCUMENTS

| | | | |
|---|---|---|---|
| 0557113 | of 1993 | European Pat. Off. . | |
| 3810174 | of 1989 | Germany . | |
| 19539604 | of 1997 | Germany . | |
| 237116 | 11/1985 | Japan | 123/41.02 |
| 362247114 | 10/1987 | Japan | 123/41.02 |
| 111617 | 5/1991 | Japan | 123/41.02 |
| 646077 | 2/1979 | U.S.S.R. | 123/41.02 |

*Primary Examiner*—Noah P. Kamen
*Assistant Examiner*—Hai Huynh
*Attorney, Agent, or Firm*—Sughrue, Mion, Zinn, Macpeak & Seas, PLLC

[57] ABSTRACT

The system includes a hydraulic circuit for supplying a flow of coolant to the engine, comprising a circulation pump, a radiator connected to the engine, a by-pass duct parallel to the radiator, and a regulating valve capable of adjusting the ratio of the flows of liquid supplied to the engine through the by-pass duct and the radiator respectively. The output of the circulation pump varies as a function of a control signal. A sensor provides signals indicating the temperature of the liquid flowing through a predetermined zone of the engine or the hydraulic circuit. An electronic unit connected to the sensor controls the pump such that the output of this latter varies depending on the temperature detected by the sensor. The regulating valve modifies the ratio of the aforesaid flows of liquid as the output of the pump varies.

3 Claims, 2 Drawing Sheets

COOLING SYSTEM FOR AN INTERNAL COMBUSTION ENGINE, PARTICULARLY FOR MOTOR VEHICLES

BACKGROUND OF THE INVENTION

The present invention concerns cooling systems for internal combustion engines, particularly for motor vehicles.

More specifically, the object of the invention is a cooling system for an internal combustion engine comprising a hydraulic circuit for supplying coolant to the engine, including a circulation pump, a radiator connected to the engine, a by-pass duct essentially parallel with the radiator, and a regulating valve capable of adjusting the ratio of the flows of coolant supplied to the engine through the by-pass duct and radiator respectively.

In cooling systems of this kind produced until now, the circulation pump is a mechanical pump, in practice incorporated in the internal combustion engine and rotated thereby. The regulating valve in these systems is a thermostatic valve.

These known systems are structurally complex and expensive and, although they operate satisfactorily, they enable only a relatively inflexible control of the engine temperature.

SUMMARY OF THE INVENTION

The object of the present invention is to produce an improved cooling system for an internal combustion engine.

This and other objects are achieved according to the invention with a cooling system of the type described above, characterised in that the output of the circulation pump varies as a function of a control signal;

a sensor is provided capable of providing signals indicating the temperature of the liquid flowing through a predetermined zone of the engine or the said hydraulic circuit;

an electronic unit for controlling the pump is connected to the sensor such that the output of the pump varies in a predetermined manner depending on the temperature detected by the sensor; and the regulating valve adjusts the ratio between the aforesaid flows of coolant as the output of the said pump varies.

BRIEF DESCRIPTION OF THE DRAWINGS

Further characteristics and advantages of the invention will become clear from the following detailed description, given purely by way of non-limitative example, with reference to the accompanying drawings, in which.

DETAILED DESCRIPTION OF THE INVENTION

Figure 1:
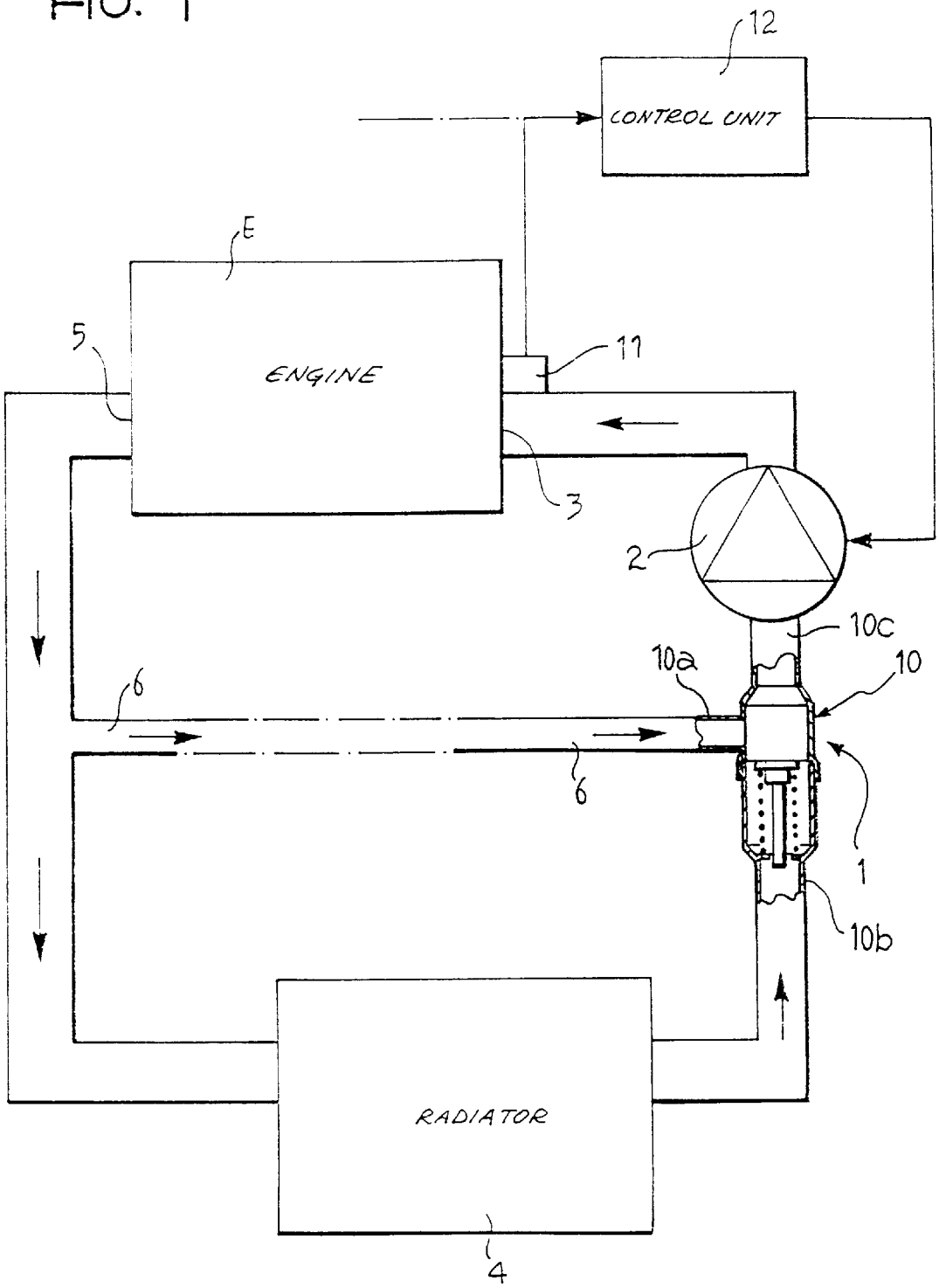
FIG. 1 is a schematic representation of an embodiment of a cooling system for an internal combustion engine according to the invention.

In FIG. 1, the letter E indicates an internal combustion engine for a motor vehicle.

A cooling system generally indicated 1 is associated with the engine E.

This system comprises a hydraulic circuit for supplying a flow of coolant to the engine E. The coolant may, for example, be a mixture of water and anti-freeze and anti-corrosion agents.

In the schematically illustrated embodiment the hydraulic circuit of the cooling system includes an electric circulation pump 2, the outlet or delivery of which is connected to the coolant inlet 3 to the engine E. The pump 2 is, for example, an electric pump, preferably of the rotary kind, the output of which varies with the speed of rotation of its rotor.

A radiator (a liquid/air heat exchanger) 4 has its inlet connected to the coolant outlet 5 from the engine E. The radiator outlet 4 is connected to an inlet 10*b* of a regulating valve generally indicated 10.

In FIG. 1, the reference numeral 6 indicates a by-pass duct connected substantially parallel to the radiator 4, between the outlet 5 of the engine E and a further inlet 10*a* of the regulating valve 10. The by-pass duct 6 may, if appropriate, extend through a heat exchanger (not shown), for example, for heating the air entering the passenger compartment.

The outlet 10*c* of the regulating valve 10 is connected to the inlet of the circulation pump 2.

An electrical temperature sensor is indicated 11 in FIG. 1. In the embodiment illustrated by way of example in this figure, the sensor 11 is located close to the coolant inlet 3 of the engine E. The temperature sensor 11 could however be located elsewhere, for example, close to the outlet 5 of the engine E, or within the engine E, or even at a predetermined point in the hydraulic circuit affected by the coolant flow.

The reference numeral 12 indicates an electronic control unit to which the outlet of the temperature sensor 11 is connected. The control unit 12 is connected to the electric motor which operates the electric pump 2, and controls the said pump in such a way that the output of this latter varies in a predetermined manner depending on the temperature detected by the sensor 11.

Figure 2:
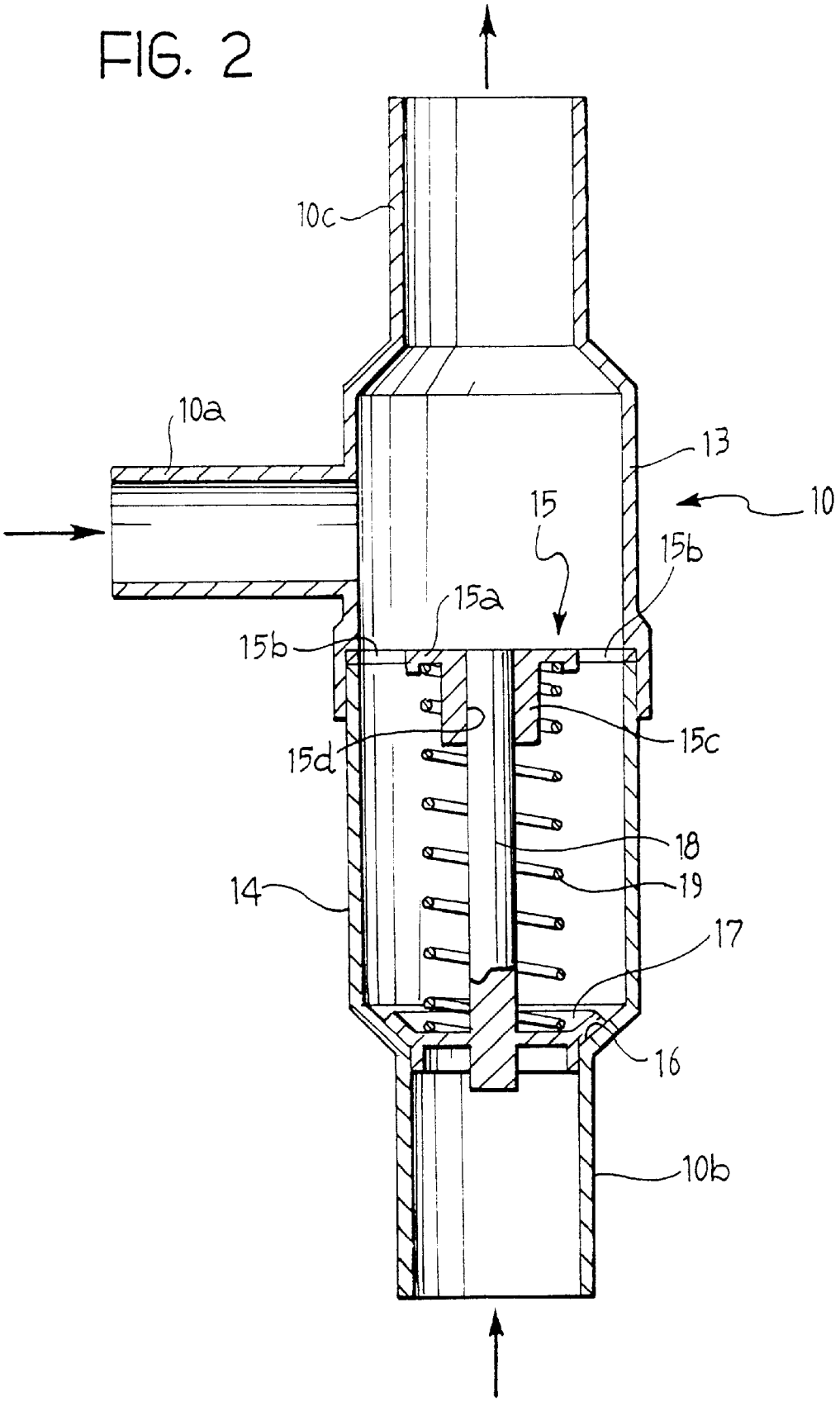
FIG. 2 is a view in section of a regulating valve included in the cooling system of FIG. 1.

As will become clearer from the description of the embodiment shown in FIG. 2, the regulating valve 10 is generally capable of adjusting the ratio between the flows of coolant supplied to the engine E through the by-pass duct 6 and the radiator 4, respectively.

The regulating valve 10 of FIG. 2 includes a hollow body formed, by way of example, in two parts 13 and 14 sealingly coupled to each other. An inlet connection 10*a* and an outlet connection 10*c* are formed in the body 10. An inlet connection 10*b* is formed in the part 14 of the valve body.

A guide element generally indicated 15 is fixed between the two parts 13 and 14 of the valve body. In the embodiment illustrated by way of example, the guide element 15 includes a disc portion 15*a* having a plurality of peripheral apertures 15*b* and a central protrusion or boss 15*c* in which an axial passage 15*d* is formed.

The part 14 of the valve body 10 has a restriction 16 close to the inlet connection 10*b*. This restriction acts as a valve seat with which a valve shutter 17 fixed to a shaft 18 slidingly mounted in the passage 15*d* of the guide element 15 cooperates.

A coil spring 19 is interposed between the disc 15*a* of the guide element 15 and the shutter 17, and holds this latter in the position illustrated in FIG. 2, that is, against the seat of the valve 16.

The cooling system described above functions as follows.

A flow of warm liquid from the engine E reaches the inlet 10*a* of the valve 10, while relatively cooler liquid from the radiator 4 reaches the inlet 10*b* of such valve.

The valve 10 is usually closed, that is, the shutter 17 usually (when the engine is cold) closes the inlet 10*b* of the valve.

When the temperature detected by the sensor 11 exceeds a predetermined value, the control unit 12 causes the electric pump 2 to rotate so that the difference between the pressures on the lower and upper surfaces of the shutter 17 exceeds the resistance of the spring 19, and the shutter 17 moves away from the seat 16, opening the way to the relatively cooler fluid coming from the radiator 4. The valve 10 then enables the warm liquid from the by-pass duct to mix with the relatively cooler liquid from the radiator 4.

The control unit 12 controls the speed of rotation of the pump 2 in such a way as to control the temperature of the fluid supplied to the engine E as desired.

The system according to the invention has various advantages.

In the first place, it is simpler and less costly than the conventional arrangements which use a pump rotated by the internal combustion engine, and a thermostatic regulating valve.

From the constructional point of view, the regulating valve 10 may be integrated, that is, formed asia unit with the electric pump itself, with consequent advantages also from the point of view of the assembly and installation of the cooling system, in particular its hydraulic circuit.

Naturally, as is evident to the expert in the field, numerous variants may be introduced into the system described above with reference to the drawings.

In particular, the regulating valve can be formed differently to that illustrated with reference to FIG. 2.

Furthermore, the pump and associated regulating valve can be located on the side where the liquid leaves the engine E, rather than on the inlet side. Finally, the circulation pump may, for example, be mechanical and rotated by the internal combustion engine via a coupling under electrical control, or electromagnetically controlled by the electronic unit 12.

Naturally, the principle of the invention remaining the same, the embodiments and details of manufacture may be widely varied with respect to that described and illustrated by way of non-limitative example, without by this departing from the ambit of the present invention as defined in the attached claims.

What is claimed is:

1. A cooling system for an internal combustion engine, including a hydraulic circuit for supplying a flow of coolant to the engine, including a circulation pump, a radiator connected to the engine, a by-pass duct essentially parallel to the radiator, and a pressure responsive regulating valve capable of adjusting the ratio of the flows of coolant supplied to the engine through the by-pass duct and the radiator, respectively;

wherein the output of the circulation pump varies as a function of a control signal;

a sensor is provided capable of providing signals indicating the temperature of the liquid flowing through a predetermined zone of the engine or said hydraulic circuit;

an electronic unit connected to the sensor is adapted to control said pump in such a way as to vary the output of this latter in a predetermined manner depending on the temperature detected by the sensor; and the pressure responsive regulating valve is adapted to adjust the ratio of the aforesaid flows of liquid as the output of said pump varies.

2. A cooling system according to claim 1, wherein said pump is a rotary electric pump.

3. A cooling system according to claim 1, wherein the pressure responsive regulating valve comprises a hollow body having first and second inlets connected respectively to the by-pass duct and the outlet of the radiator, and an outlet connected to the coolant inlet to the engine; the first inlet of the valve being permanently in communication with the outlet; a valve seat being provided between the second inlet and the outlet, with which seat is associated a valve shutter movable in the body; said shutter being able to move away from the seat against the action of biasing means when the pressure difference between the region of the body upstream of the seat and the region downstream of the said seat exceeds a predetermined value.

* * * * *